US008465231B2

(12) United States Patent
Christopher

(10) Patent No.: US 8,465,231 B2
(45) Date of Patent: Jun. 18, 2013

(54) GRADUATED SILT FENCE

(76) Inventor: Hunt Lee Christopher, Laurelville, OH (US)

( * ) Notice: Subject to any disclaimer, the term of this patent is extended or adjusted under 35 U.S.C. 154(b) by 310 days.

(21) Appl. No.: 12/814,459

(22) Filed: Jun. 13, 2010

(65) Prior Publication Data

US 2011/0305530 A1 Dec. 15, 2011

(51) Int. Cl.
*E02D 17/20* (2006.01)
*D03D 13/00* (2006.01)
*E01F 7/02* (2006.01)

(52) U.S. Cl.
USPC ..... 405/302.7; 442/203; 256/12.5

(58) Field of Classification Search
USPC ..... 405/15, 16, 21, 302.7; 442/203, 442/208, 209, 217; 256/12.5
See application file for complete search history.

(56) References Cited

U.S. PATENT DOCUMENTS 4,279,535 A * 7/1981 Gagliardi et al. ..... 405/15
5,108,224 A * 4/1992 Cabaniss et al. ..... 256/12.5
5,348,419 A * 9/1994 Bailey et al. ..... 405/21
5,735,640 A * 4/1998 Meyer et al. ..... 405/302.7
6,558,075 B2 * 5/2003 Benedict et al. ..... 405/21
6,616,383 B2 * 9/2003 Janz ..... 405/302.7
6,722,817 B2 * 4/2004 Benedict et al. ..... 405/21
7,465,129 B2 * 12/2008 Singleton ..... 405/302.7
2001/0052595 A1 * 12/2001 Hulett ..... 256/11
2006/0133897 A1 * 6/2006 Allard et al. ..... 405/43
2008/0112766 A1 * 5/2008 Kerman ..... 405/302.7
2010/0248574 A1 * 9/2010 King et al. ..... 442/205

* cited by examiner

*Primary Examiner* — Frederick L Lagman
*Assistant Examiner* — Kyle Armstrong
(74) *Attorney, Agent, or Firm* — Blynn L. Shideler; Krisanne Shideler; BLK Law Group

(57) ABSTRACT

An geotextile silt fence has an increasing permittivity with increase in height thereby allowing larger storm events to flow through the fence without overtopping. A stiffening device is provided at the top of the silt fence to reduce sagging and improper overtopping. This stiffening device may be a mono-directional extruded geogrid structure that is a higher mil thickness than the geotextile monofilament structure of the silt fence and which is affixed to the geotextile continuously throughout the silt fence length. An overflow preferential pathway may be provided at the top of the silt fence through large voids within the geogrid providing controlled overflow of impounded water which mitigates structural failure of the silt by eliminating the typical overtopping failure mechanism.

6 Claims, 2 Drawing Sheets

GRADUATED SILT FENCE

TECHNICAL FIELD AND INDUSTRIAL APPLICABILITY OF GRADUATED SILT FENCE

This invention relates to modifications of conventional silt fence also known as filter fabric fence. Silt fence is utilized extensively as a sediment and erosion control device, also known as a best management practice, for construction site stormwater runoff. In practice, these fences often fail by overtopping of silt-laden stormwater runoff because of the lack of increased flow rate of said fence during relatively larger runoff events. Therefore, it would be desirable to provide increased flow rate through the fence during larger runoff events and to provide an overflow mechanism that eliminates overtopping failures. The present invention relates to eliminating failure of silt fence by providing increased flow rate for larger storm runoff events and a preferential overflow location to eliminate failure by overtopping.

BACKGROUND OF GRADUATED SILT FENCE

Silt fence, or filter fabric fence, is a temporary linear sediment barrier of permeable fabric designed to intercept and slow the flow of sediment-laden sheet flow runoff from areas of erodible soil. Silt fence is made of woven synthetic filtration fabric (also known as geosynthetic or geotextile). Geotextiles are manufactured by tightly stretched lengthwise polymer strands, known as warp, woven with filler polymer strands, known as weft. These materials often contain identical warp and weft strands creating what is known as an even weave. The conventional silt fence has uniform geotextile weaving producing a constant permittivity (permittivity=cross-plane permeability coefficient / thickness at specified normal pressure) throughout the material's height and length. Mud cake reduction in permittivity is also uniform for conventional silt fence. Typical width of the geotextile is 24 to 36 inches. Any desired length of the geotextile can be manufactured as it is transported in rolls.

Proper installation of the woven geotextile requires support vertically by steel or wood posts in plurality, properly spaced to such length as to be substantially strong to hold the geotextile silt fence upright while impounding water to its capacity. The silt fence material should be stretched between support posts to assure it is taunt to prevent sag failure. Said fences require installation in a linear fashion along a constant topography and entrenched to create a seal with the earth. Because said fence is entrenched throughout its length into the soil, it creates a vertical hydraulic barrier providing a temporary impoundment. Therefore, the entrenched portion must be water tight to provide a vertical slurry barrier with the soil. Therefore, larger storms, either by long duration or high intensity, create greater depth of impounded water behind the fence.

The purpose of silt fence is to prevent sediment carried by sheet flow stormwater runoff from leaving denuded areas such as construction sites and entering natural waters or storm drainage systems. This best management practice treats sediment-laden stormwater runoff and reduces erosion by slowing the velocity of runoff, thereby causing the deposition of sediment at the structure interface. Silt fencing encourages sheet flow at the discharge as a level spreader and reduces the potential for development of rills and gullies which are aggressive forms of erosion.

Silt fence is widely utilized as a best management practice for construction activities which denude soil, exposing it to erosion. Because of their widespread use, systematic failure of silt fence devices allows significant sediment loads to reach natural waters. Typically, failure of silt fence occurs from two mechanisms: improper installation or hydraulic overtopping.

Improper installation leads to such failures as sediment-laden water flowing around or underneath the silt fence. When silt fence is impounding runoff at a depth equivalent to the installed fence height, vertical portions of the hydrostatic forces at the wetted fence interface create a concave structure perpendicular to the horizontal ground surface centered nearly at the center of the height of the silt fence.

Overtopping failure occurs because excessive stormwater runoff impounded by the silt fence forces the material to sag by physical submersion and subsequent loss of the uplifting vertical hydrostatic forces acting upon the upper portions of the installed fence. Loss of the upward containment forces on the geotextile allows reduction in height of the fence in upper portions of the fence. The loss of uplift forces in this critical location creates catastrophic failure of the device. A significant amount of water and suspended sediment impounded by the fence is released quickly in these sag failures. Because the failure discharge is uncontrolled, relatively high discharge velocities are common. High velocities transport significant loads of sediment to natural waters. Elimination of sag failure by control of the overflow would reduce discharge velocities minimizing sediment load discharged.

Overtopping occurs frequently because silt fence has not previously been designed to provide higher flow rate for greater intensity and duration storm events. If the fence could allow greater flow rates at higher levels in the barrier, the frequency of catastrophic overtopping failures would be significantly reduced. In addition, if the barrier had a non-overtopping location intended for allowance of overflow, elimination of overtopping failures would be achieved. These two overtopping failure elimination devices are a product of this invention.

BRIEF DESCRIPTION OF THE PREFERRED EMBODIMENTS

Figure 1:
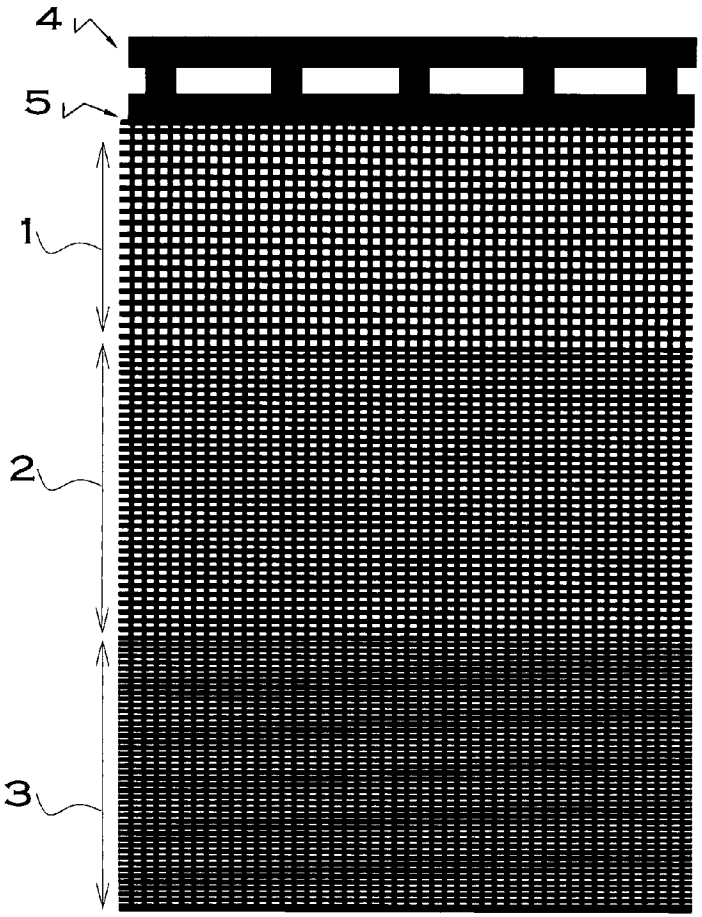
FIG. 1 is a schematic view of a short section of a first embodiment of a graduated silt fence according to a first embodiment of the present invention.

FIG. 1 is a profile view of a short section of a first embodiments of the invention. Item 1 is the high permittivity section of the embodiment. Item 2 is the mid-range permittivity section of the embodiment. Item 3 is the low permittivity section of the embodiment. Item 4 is the support and overflow geogrid of the invention. Item 5 is the seaming location of geotextile to the geogrid. FIG. 1 is not drawn to scale. The flat polymer threads representing the warp and weft are shown separated much greater than the actual silt fence product to provide visual understanding of the change in permittivity with width (or installed height) of the invention.

Figure 2:
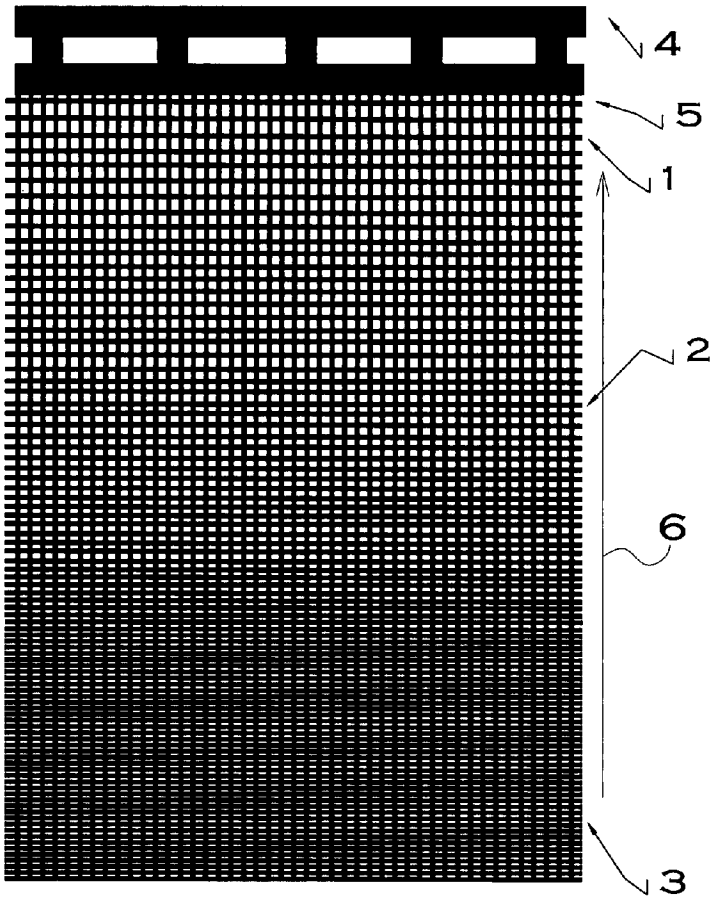
FIG. 2 is a schematic view of a short section of a second embodiment of a graduated silt fence according to a second embodiment of the present invention.

FIG. 2 is a profile view of a short section of the a second embodiments of the invention. Item 1 is the high permittivity location of the embodiment. Item 2 is the mid-range permittivity location of the embodiment. Item 3 is the low permittivity location of the embodiment. Item 4 is the support and overflow geogrid of the invention. Item 5 is the seaming location of geotextile to the geogrid. Item 6 indicates the direction of increasing permittivity of the embodiment. FIG. 2 is not drawn to scale. The flat polymer threads representing the warp and weft are shown separated much greater than the actual silt fence product to provide visual understanding of the change in permittivity with width (or installed height) of the invention.

Figure 3:
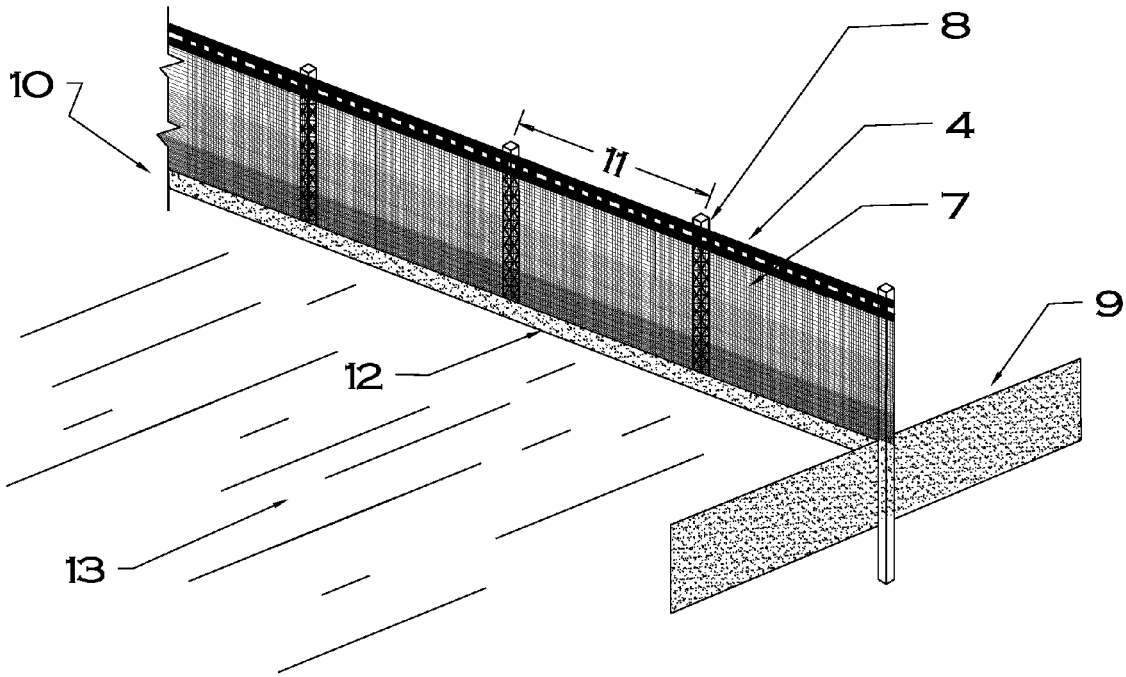
FIG. 3 is a schematic perspective view of a short section of a graduated silt fence according to the present invention.

FIG. 3 is an isometric view of a typical installation of the first and second embodiments of the invention. Item 4 is the overflow and support geogrid of the embodiment. Item 7 is the Graduated Silt Fence geotextile. Item 8 are wooden post of substantial strength and driven deep enough to hold runoff flow depths to the capacity of the Graduated Silt Fence. Item 9 is a representation of the ground surface. Item 10 indicates the location of entrenchment of the geotextile into the existing ground surface. Item 11 represents the wooden post spacing. Item 12 is the compacted backfill. Item 13 represents the flow direction of runoff in this treatment scheme. FIG. 3 is not drawn to scale. The flat polymer threads representing the warp and weft are shown separated much greater than the actual silt fence product to provide visual understanding of the change in permittivity with width (or installed height) of the invention.

Figure 4:
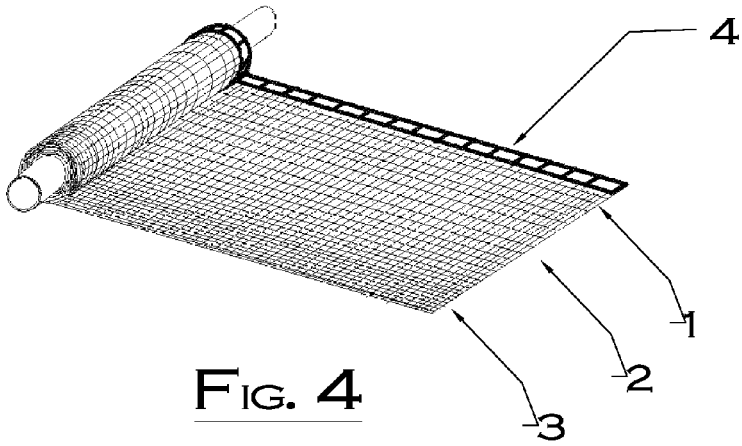
FIG. 4 is a schematic view of a stock roll of a graduated silt fence according the present invention.

FIG. 4 is an isometric representation of a typical stock roll of the first and second embodiments of the invention. Item 1 is the high permittivity section of the embodiment. Item 2 is the mid-range permittivity section of the embodiment. Item 3 is the low permittivity section of the embodiment. Item 4 is the overflow and support geogrid of the embodiment. FIG. 4 is not drawn to scale. The flat polymer threads representing the warp and weft are shown separated much greater than the actual silt fence product to provide visual understanding of the change in permittivity with width (or installed height) of the invention.

When installed as intended the Graduated Silt Fence would provide low permittivity (highly restrictive flow rate) for lower portions of the fence to collect and maintain high treatment standards for frequent small volume and/or short duration rainfall (low flow runoff events). As height increases, the geotextile contains greater permittivity created by change in material weave, material geometry, or by material strength effectively providing larger void spaces within the textile structure. Larger effective void spaces allows an increase in flow rate through the fence providing treatment for larger rainfall/runoff events preventing frequent failure observed by overtopping of conventional silt fence.

A support geogrid (typically mono-directional extruded material) is attached by seaming or other means to the top of Graduated Silt Fence or conventional silt fence to provide vertical and horizontal support of the geotextile fence. The geogrid is greater mil polymer (thicker and stiffer) material than the woven geotextile and is formed as a continuous strand of hollow rectangular structures along the top length of the woven geotextile. The geogrid provides horizontal and vertical support to the installed silt fence best management practice. The geogrid reduces stretching and sagging of the woven geotextile.

Additionally, the geogrid can be slotted (third embodiment) to provide an overflow preferential pathway at the upper portion of the installed silt fence through the geogrid. This preferential overflow pathway will to allow the overflow without overtopping thereby eliminating structural failure of the silt fence system by typical overtopping failure mechanism. The slots can be of any geometry, but preferably large rectangular or circular voids.

I claim the following inventions:

1. A graduated silt fence comprising a woven geotextile fabric that includes a cross-plane permeability coefficient defining a permittivity which is increasing from one width edge and to the opposite width edge of the geotextile fabric, wherein the change in the permittivity is accomplished by a variation in weaving pattern, and wherein the variation in the permittivity throughout the geotextile width remains constant throughout the geotextile length, whereby when installed, the graduated silt fence provides a low permittivity for lower portions of the fence and as height increases, the geotextile fabric contains a greater permittivity created by change in material weave providing the greater permittivity within the textile structure allowing an increase in flow rate through the fence, wherein the variation in weaving pattern includes the use of a plain weave, adjacent a twill weave section, adiacent a satin weave section and further including a support geogrid formed of a mono-directional extruded material that is attached to the top of geotextile fabric and is of a greater material thickness and stiffness than the woven geotextile and is formed as a continuous strand of hollow rectangular structure along the top length of the woven geotextile, and wherein the geogrid is slotted to provide an overflow preferential pathway at the upper portion of the installed silt fence through the geogrid.

2. The graduated silt fence according to claim 1 wherein the geogrid is slotted to provide an overflow preferential pathway at the upper portion of the installed silt fence through the geogrid.

3. A graduated silt fence comprising a woven geotextile fabric that includes a cross-plane permeability coefficient defining a permittivity which is increasing from one width edge and to the opposite width edge of the geotextile fabric, wherein the change in the permittivity is accomplished by a variation in change in warp strain deformation resistance of the geotextile fabric, and wherein the variation in the permittivity throughout the geotextile width remains constant throughout the geotextile length, whereby when installed, the graduated silt fence provides a low permittivity for lower portions of the fence and as height increases, the geotextile fabric contains a greater permittivity created by change in warp strain deformation resistance of the geotextile fabric providing the greater permittivity within the textile structure allowing an increase in flow rate through the fence, and further including a support geogrid formed of a mono-directional extruded material that is attached to the top of geotextile fabric and is of a greater material thickness and stiffness than the woven geotextile and is formed as a continuous strand of hollow rectangular structure along the top length of the woven geotextile.

4. The graduated silt fence according to claim 3 wherein the geogrid is slotted to provide an overflow preferential pathway at the upper portion of the installed silt fence through the geogrid.

5. A graduated silt fence comprising a woven geotextile fabric that includes a cross-plane permeability coefficient defining a permittivity which is increasing from one width edge and to the opposite width edge of the geotextile fabric, wherein the change in the permittivity is accomplished by a variation in weft material width, and wherein the variation in the permittivity throughout the geotextile width remains constant throughout the geotextile length, whereby when installed, the graduated silt fence provides a low permittivity for lower portions of the fence and as height increases, the geotextile fabric contains a greater permittivity created by variation in weft material width providing the permittivity within the textile structure allowing an increase in flow rate through the fence, and further including a support geogrid formed of a mono-directional extruded material that is attached to the top of geotextile fabric and is of a greater material thickness and stiffness than the woven geotextile and is formed as a continuous strand of hollow rectangular structure along the top length of the woven geotextile.

6. The graduated silt fence according to claim 5 wherein the geogrid is slotted to provide an overflow preferential pathway at the upper portion of the installed silt fence through the geogrid.

* * * * *

UNITED STATES PATENT AND TRADEMARK OFFICE

CERTIFICATE OF CORRECTION

PATENT NO. : 8,465,231 B2
APPLICATION NO. : 12/814459
DATED : June 18, 2013
INVENTOR(S) : Christopher Lee Hunt It is certified that error appears in the above-identified patent and that said Letters Patent is hereby corrected as shown below:

On the Title page, items 12 and 76
Inventor name should read – Christopher Lee Hunt Signed and Sealed this
Sixth Day of August, 2013

Teresa Stanek Rea
*Acting Director of the United States Patent and Trademark Office*